United States Patent [19]

Maldon

[11] 3,987,932

[45] Oct. 26, 1976

[54] DISPENSER FOR RESTROOMS

[75] Inventor: Ronald L. Maldon, Columbus, Ohio

[73] Assignee: The Raymond Lee Organization, Inc., New York, N.Y. ; a part interest

[22] Filed: Jan. 5, 1976

[21] Appl. No.: 624,489

[52] U.S. Cl. ..... 221/96; 222/129; 222/93

[51] Int. Cl.[2] ..... A47F 1/00

[58] Field of Search ..... 222/93, 132, 94, 144.5, 222/105, 129; 221/96

[56] References Cited

UNITED STATES PATENTS

| | | | |
|---|---|---|---|
| 2,609,122 | 9/1952 | Stenerson | 222/93 X |
| 2,667,287 | 1/1954 | Cook | 222/93 X |
| 3,434,629 | 3/1969 | Hooge et al. | 221/96 X |

*Primary Examiner*—Allen N. Knowles

[57] ABSTRACT

A housing is attached to a restroom wall. Inside the housing is a first means that can release the bottom cup from a stack of disposable cups stored in the housing. A second means can introduce mouthwash inside the released cup when operated. A conventional tube of toothpaste is supported in a frame inside the housing, in a vertical, downwardly pointed position. Both the first and second means are controlled by push buttons that are located on the front of the housing. Another push button located on the front of the housing can cause the toothpaste tube to be squeezed when pressed, causing toothpaste to be squeezed downwardly out of the tube.

4 Claims, 3 Drawing Figures

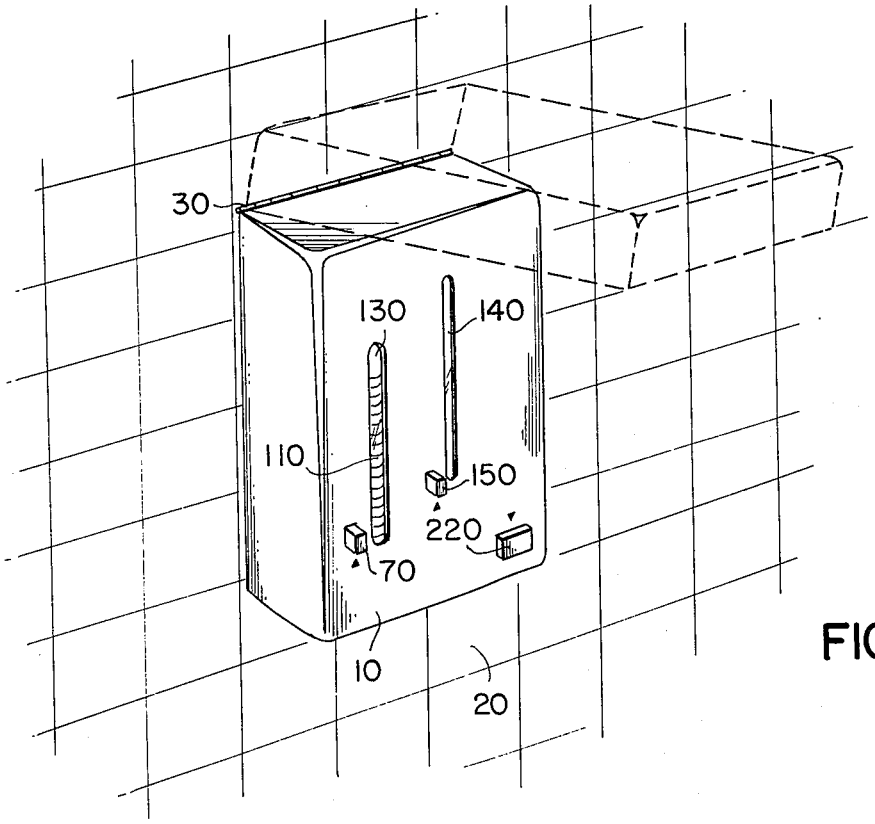
FIG. 1
FIG. 3
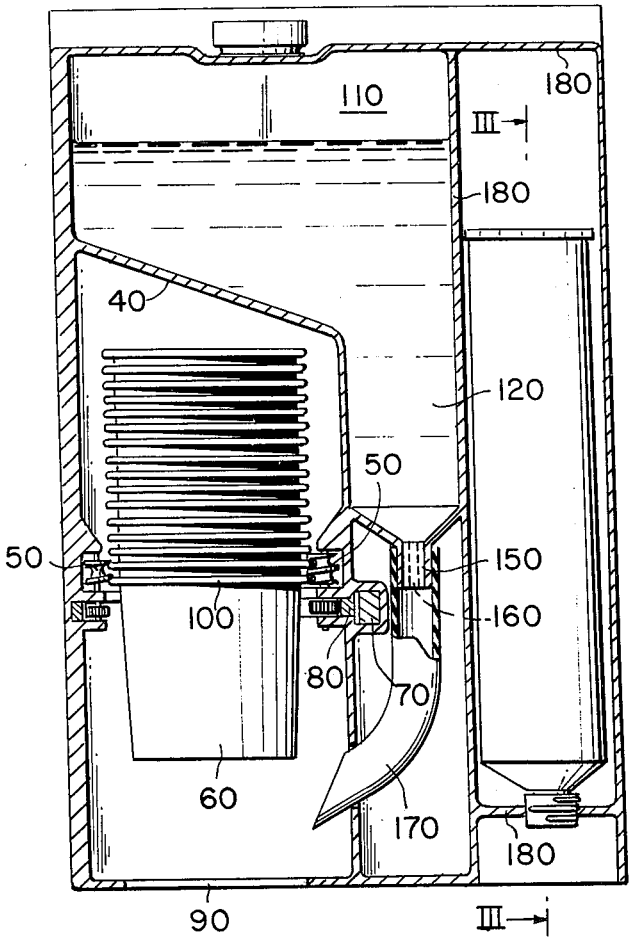
FIG. 2
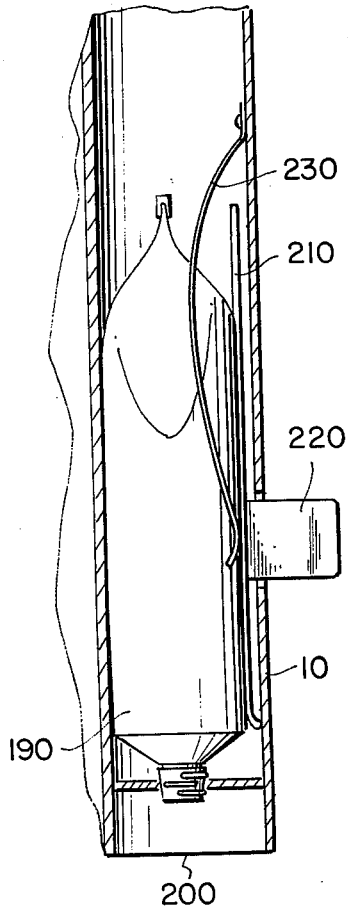

DISPENSER FOR RESTROOMS

SUMMARY OF THE INVENTION

This invention is designed to be mounted upon the walls of restrooms. Its purpose is to provide a device for dispensing disposable cups, mouthwash, and toothpaste in a convenient manner.

In this invention, each of the above functions is controlled by depressing a corresponding push button. These push buttons are placed at the front of the housing which contains the mechanism of the invention. Inside this housing is located a first means that holds a stack of disposable cups and that releases the bottom cup in the stack when the proper button is depressed. The housing also contains a reservoir that holds mouthwash, together with a second means that introduces mouthwash into a released cup, when another button is depressed. Finally, a frame inside the housing supports a conventional tube of toothpaste in a downwardly pointed position. When a third button is depressed, the tube is squeezed and toothpaste squeezed downwardly out of the tube.

BRIEF DESCRIPTION OF THE DRAWINGS

FIG. 1 is a drawing of the invention in use.

FIG. 2 is a frontal cross-sectional view of the invention.

FIG. 3 is a side cross-sectional view of the invention.

DETAILED DESCRIPTION OF THE PREFERRED EMBODIMENT

A box shaped housing 10 is attached to the wall 20 of a restroom by a hinge 30 that allows the housing to be pivoted upwardly as a unit for refilling purposes.

Attached to ribs 40 molded in the housing are two opposed worm gears 50 mounted with their axes aligned vertically. A stack of disposable cups 60 is supported by the gears, which engage the two lowest cups on the right-hand side and the second lowest cup on the left-hand side. When a first push button 70 is depressed, a rack and pinion 80 rotates the right-hand gear to release the lowest cup in the stack. This cup then falls through hole 90 in the bottom of the housing and stops as the upper circular lip 100 of the cup abuts the periphery of the hole. At this point, if desired, mouthwash may be introduced into the cup.

A reservoir 110 is filled with mouthwash 120 and is made of transparent material. A vertical slot 140 in the front of the housing indicates thus the level of mouthwash in the reservoir, just as a similar slot 130 in the housing directly in front of the stack of cups allows the number of cups remaining in the stack to be identified. When spring loaded button 150 is depressed, a vertical bore 160 is aligned with the constructed lower end of the reservoir to allow mouthwash to flow into the cup via hollow pipe 170. When a sufficient amount of mouthwash has been allowed to fill the cup, the cup may be snapped out of the hole 90 and used.

Finally, ribs 180 form a vertically elongated hollow rectangular structure that serves as a frame to hold a conventional toothpaste tube 190 in a vertical, downwardly pointed position. The tube is inserted into the device with the cap off, to allow toothpaste to be squeezed downwardly out of the hole 200 in the bottom of the housing.

To squeeze the tube, a vertical plate 210 is attached to the rear of push button 220 that is mounted on the front of the housing. When the push button 220 is depressed against the pressure of the metal leaf spring 230 that presses against the plate, the tube is squeezed against the rear of the housing and toothpaste is forced downwardly out.

Although the invention has been described with particular reference to the drawings, the protection sought is to be limited only by the terms of the claims which follow.

What is claimed is:

1. A dispenser for restrooms, comprising:

a housing attached to a wall of the restroom;

a first means for holding a vertical stack of disposable cups in the housing and releasing the lowest cup in the stack when operated;

a first push button attached to the front of the housing for operating the first means;

a reservoir in the housing for storing liquid mouthwash;

a second means attached to the reservoir for introducing the mouthwash into a cup that has been released;

a second push button attached to the front of the housing for operating the second means;

a frame in the housing for supporting a conventional tube of toothpaste in a vertical, downwardly pointed position; and a third push button attached to the front of the housing for squeezing the tube when pressed and thus causing toothpaste to be squeezed downwardly out of the tube.

2. The dispenser of claim 1 wherein the reservoir is made of a transparent substance and the front of the housing is cut away to expose the level of mouthwash inside it.

3. The dispenser of claim 2 further including a second cut away portion in the front of the housing for exposing said stack.

4. The dispenser of claim 3 wherein the housing has ribs forming said frame.

* * * * *